US011355096B1

(12) United States Patent
Gandhi

(10) Patent No.: US 11,355,096 B1
(45) Date of Patent: Jun. 7, 2022

(54) ADAPTIVE FEEDBACK PROCESSING FOR CONSISTENT HEADPHONE ACOUSTIC NOISE CANCELLATION

(71) Applicant: Apple Inc., Cupertino, CA (US)

(72) Inventor: Navneet Gandhi, Santa Clara, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/023,314

(22) Filed: Sep. 16, 2020

(51) Int. Cl.
*G10K 11/178* (2006.01)

(52) U.S. Cl.
CPC .. *G10K 11/17875* (2018.01); *G10K 11/17854* (2018.01); *G10K 2210/30232* (2013.01); *G10K 2210/30391* (2013.01)

(58) Field of Classification Search
CPC ..... G10K 11/178; G10K 11/1785; G10K 11/17853; G10K 11/17854; G10K 2210/3017; G10K 2210/3022; G10K 2210/30232; G10K 2210/3055
See application file for complete search history.

(56) References Cited

U.S. PATENT DOCUMENTS

| | | | | |
|---|---|---|---|---|
| 5,359,665 | A | 10/1994 | Werrbach | |
| 7,016,509 | B1 | 3/2006 | Bharitkar et al. | |
| 7,171,010 | B2 | 1/2007 | Martin et al. | |
| 8,275,152 | B2 | 9/2012 | Smirnov et al. | |
| 8,693,700 | B2 | 4/2014 | Bakalos et al. | |
| 9,264,823 | B2 | 2/2016 | Bajic et al. | |
| 9,515,629 | B2 | 12/2016 | Goldstein et al. | |
| 9,633,646 | B2 | 4/2017 | Hendrix et al. | |
| 10,034,092 | B1 | 7/2018 | Nawfal et al. | |
| 2003/0145025 | A1 | 7/2003 | Allred et al. | |
| 2004/0032959 | A1 | 2/2004 | Montag et al. | |
| 2008/0175409 | A1 | 7/2008 | Lee et al. | |
| 2010/0266134 | A1* | 10/2010 | Wertz | G10K 11/17879 381/71.1 |
| 2014/0093090 | A1 | 4/2014 | Bajic et al. | |
| 2016/0300562 | A1* | 10/2016 | Goldstein | G10K 11/17881 |
| 2017/0125006 | A1* | 5/2017 | Dzhigan | G10K 11/17881 |
| 2019/0130930 | A1 | 5/2019 | Tong et al. | |

(Continued)

FOREIGN PATENT DOCUMENTS

| | | |
|---|---|---|
| EP | 2239728 | 10/2010 |

OTHER PUBLICATIONS

"Bose QuietComfort Earbuds", Retrieved from the Internet <https://www.bose.com/en_us/products/headphones/earbuds/quietcomfort-earbuds.html#v=qc_earbuds_black, Sep. 10, 2020, 15 pages.

(Continued)

*Primary Examiner* — Kile O Blair
(74) *Attorney, Agent, or Firm* — Womble Bond Dickinson (US) LLP

(57) ABSTRACT

An internal microphone signal of a headphone is filtered by i) a first filter G that, as part of an acoustic noise cancellation, ANC, subsystem, produces an anti-noise audio signal, and ii) a second filter C to produce a feedback audio signal. An estimate of a transfer function of a path S is determined, wherein the path S is from i) an input of a speaker of the headphone to ii) the internal microphone signal. The second filter C is adapted based on the estimate of the transfer function of the path S drives an input of a speaker of the headphone. Other embodiments are also described.

22 Claims, 6 Drawing Sheets

(56) References Cited

U.S. PATENT DOCUMENTS

| | | | |
|---|---|---|---|
| 2021/0097970 | A1 | 4/2021 | Saux et al. |
| 2021/0099799 | A1 | 4/2021 | Saux et al. |

OTHER PUBLICATIONS

Bristow-Johnson, Robert, "Cookbook formulae for audio equalizer biquad filter coefficients", Retrieved from the Internet <https://www.w3.org/2011/audio/audio-eq-cookbook.html>, May 29, 2020, 7 pages.
Notice of Allowance for U.S. Appl. No. 17/019,778 dated Jun. 24, 2021, 18 pages.

* cited by examiner

ADAPTIVE FEEDBACK PROCESSING FOR CONSISTENT HEADPHONE ACOUSTIC NOISE CANCELLATION

FIELD

An aspect of the disclosure here relates to digital signal processing techniques for improving acoustic noise cancellation performance in headphones. Other aspects are also described.

BACKGROUND

Headphones let their users listen to music and participate in phone calls without disturbing others who are nearby. They are used in both loud and quiet ambient environments. Headphones can have various amounts of passive sound isolation against ambient noise. There may be in-ear rubber tips, on-ear cushions, or around-the-ear cushions, or the sound isolation may be simply due to the against the ear headphone housing loosely blocking the entrance to the ear canal. An electronic technique known as acoustic noise cancellation, ANC, is used to further reduce the ambient noise that has leaked past the passive isolation. ANC drives a headphone speaker to produce an anti-noise sound wave that is electronically designed to cancel the ambient noise that makes it in the user's ear. But the performance of ANC varies greatly, depending on how the headphone is fitting to the wearers ear.

SUMMARY

An adaptive digital filter C is added into an audio signal feedback path of a headphone audio system, wherein the audio signal path is from the output of an internal microphone (e.g., error microphone) of a headphone to the input of a speaker of the headphone. A path S is defined from the input of the speaker to the output of the internal microphone. The feedback path contains another digital filter G that, as part of an acoustic noise cancellation, ANC, subsystem, produces an anti-noise audio signal. The filter C is coupled in cascade with the filter G. In one aspect, the filter C is designed to operate over a wide audio frequency band, e.g., 10 Hz to 10 kHz, not just in a low frequency band where ANC is typically effective. The system adapts the filter C online, based on an online estimate of the transfer function of the path S. In this manner, the addition of the filter C helps the ANC subsystem to more consistently reduce the ambient noise that has leaked past the headphone's passive isolation and into the ear despite variation in how the headphone fits the ear. As a result, the headphone performs more consistently across different users. This benefit may be had during both a playback mode (the wearer of the headphone can hear a user content playback signal that is driving the speaker) and an earplug mode (the wearer wants it to be quiet, and does not want to hear the ambient environment.)

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

In various aspects, the description here is made with reference to figures. However, certain aspects may be practiced without one or more of these specific details, or in combination with other known methods and configurations. The aspects are thus illustrated by way of example and not by way of limitation in the figures in which like references indicate similar elements. It should be noted that references to "an" or "one" aspect of this disclosure are not necessarily to the same aspect, and they mean at least one. Also, in the interest of conciseness and reducing the total number of figures, a given figure may be used to illustrate the features of more than one aspect, and not all elements in the figure may be required for a given aspect.

DETAILED DESCRIPTION

In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment," or the like, means that a particular feature, structure, configuration, or characteristic described is included in at least one embodiment. Thus, the appearance of the phrase "one embodiment," "an embodiment," or the like, in various places throughout this specification are not necessarily referring to the same embodiment. Furthermore, the particular features, structures, configurations, or characteristics may be combined in any suitable manner in one or more embodiments.

Figure 1:
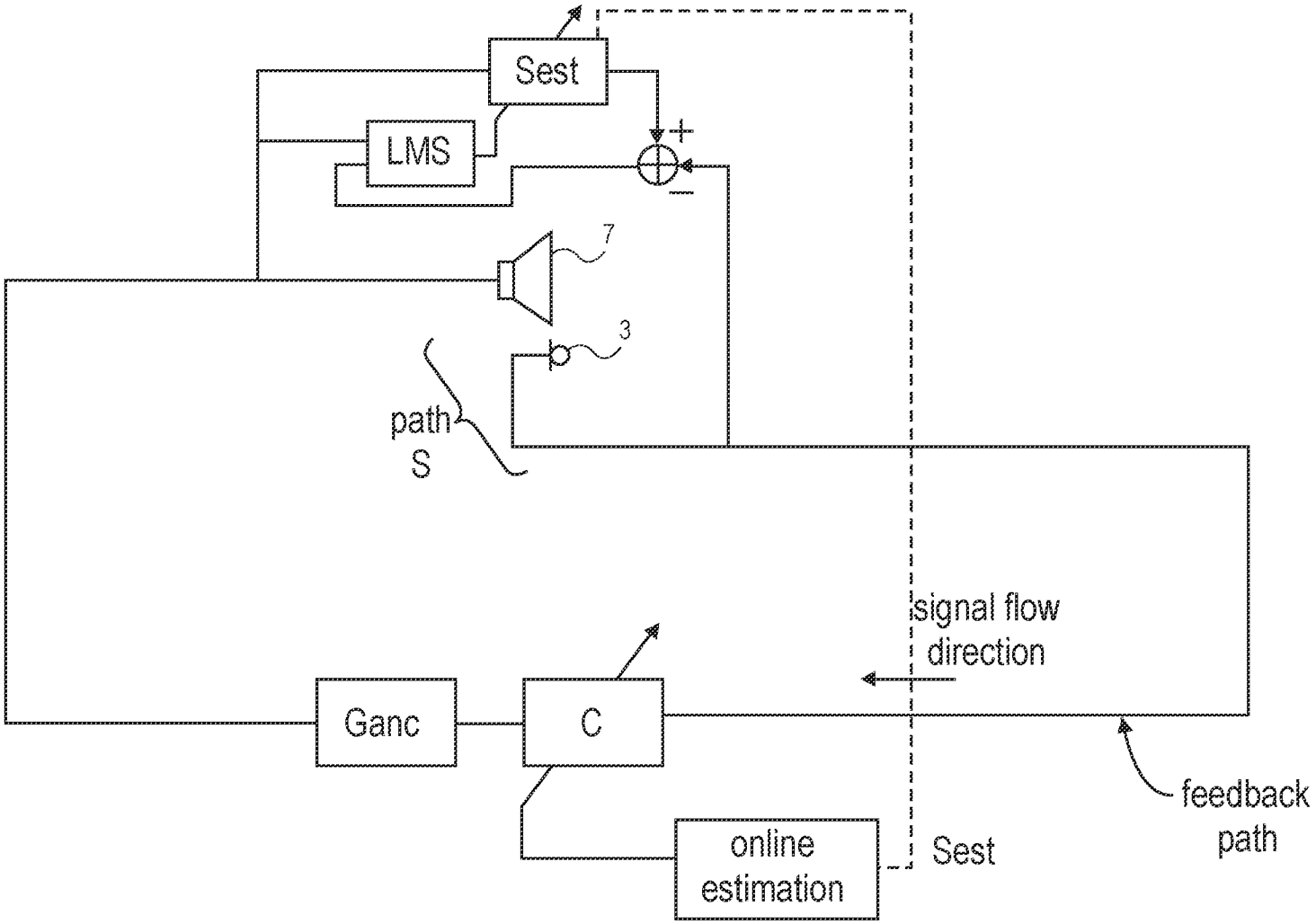
FIG. 1 is a block diagram of part of a headphone audio system showing a feedback path.

FIG. 1 shows a block diagram of part of a headphone audio system (headphone) that can be worn by its user or wearer against their ear (not shown), and in which the systems and methods for digital audio signal processing described below can be implemented. The headphone may be an in-ear earbud, such as a sealing-type that has a flexible ear tip that serves to acoustically seal off the entrance to the user's ear canal from the ambient environment by blocking or occluding in the ear canal (thereby achieving strong passive ambient sound isolation), or it may be a looser fitting earbud. The headphone may be one of two headphones (left and right) that make up a headset. The methods described below can be implemented in one or both of the headphones that make up a headset. Alternatives to an in-ear earbud include a closed back, on-the-ear headphone or an over-the-ear headphone that could also create a strong, passive ambient sound barrier. In all such instances, the way in which the headphone fits the wearers ear affects how a pocket of air is trapped at the ear and this affects how the wearer of the headphone can hear sound produced by a speaker in the headphone and also how well an acoustic noise cancellation, ANC, process can reduce the unwanted ambient sound that has leaked into the ear.

Figure 6:
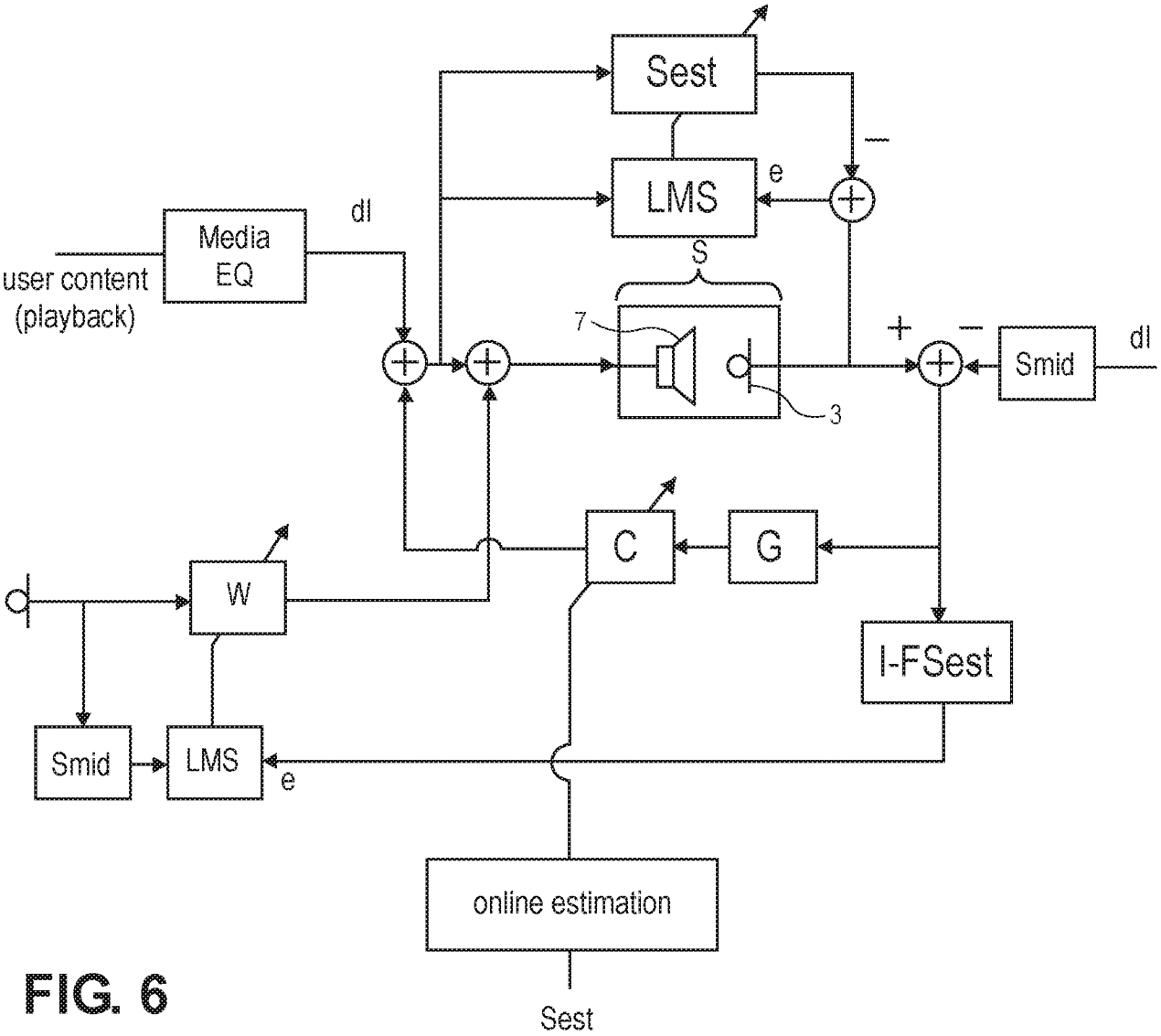
FIG. 6 is a block diagram of part of a headphone audio system having adaptive Feedword ANC combined with an adaptive feedback path.

The headphone has integrated therein an against-the-ear acoustic transducer or speaker 7 arranged or configured to reproduce sound that is represented in an input digital audio signal, directly into the ear of a wearer (user.) There is also an internal microphone 3 that is arranged or configured to directly receive the sound reproduced by the speaker 7. In some instances, the headphone also has integrated therein an external microphone 5—see FIG. 6—arranged or configured to receive ambient sound directly. The headset is configured to acoustically couple the external microphone 5 to an ambient environment of the headphone, in contrast to the internal microphone 3 being acoustically coupled to a trapped volume of air within the ear that is being blocked by the headphone. In one variation, as integrated in the headphone and worn by its user, the external microphone 5 may be more sensitive than the internal microphone 3 to a far field sound source outside of the headphone. Viewed another way, as integrated in the headphone and worn by its user, the external microphone 5 may be less sensitive than the internal microphone 3 to sound within the user's ear. Here it should be noted that while FIG. 1 and FIG. 6 show a single microphone symbol in each instance (external microphone 5 and internal microphone 3), as producing a sound pickup channel, this does not mean that the sound pickup channel must be produced by only one microphone. In some instances, the sound pickup channel may be the result of combining multiple microphone signals, e.g., by a beamforming process performed on a multi-channel output from a microphone array.

In one aspect, along with the microphone there is other electronics that may be integrated in the headphone housing including a microphone sensing and conversion circuit that receives the microphone signal from the internal microphone 3 converts it into a desired format for digital signal processing, an audio amplifier to drive the speaker 7 based on a digital input audio signal, and a digital processor and associated memory (not shown separately) where the memory stores instructions for configuring or programing the processor (e.g., instructions to be executed by the processor) to perform the digital signal processing methods that are described below and shown in blocks in the figures. A playback or user content audio signal (program audio) that may contain user content such as music, podcast, or the voice of a far end user during a voice communication session is also be provided to drive the speaker 7 during playback mode—see FIG. 6 for example. The user content signal may be provided to the processor over a wired or wireless communication link from an external, companion audio source device (not shown in the example of FIG. 1) such as a smartphone or a tablet computer, or from a remote server over the Internet or through a cellular network communications interface that is within the housing of the headphone.

Still referring to FIG. 1, in the headphone audio system the method for audio signal processing is performed for the most part "online", that is in real-time by a processor (such as one that is integrated in the headphone housing) while the headphone is being worn by its owner (wearer or user) for its intended use in either a headphone playback mode (user content signal is loud) or in an active ear plug mode (in which the user content signal is quiet.) This is contrast to certain operations described below which may be performed "offline", that is not during the intended use, e.g., during a power on self-test of the headphone, a software update, or at the factory before the headphone has been shipped to its owner. In the online method, during either playback mode or during active earplug mode, the processor filters an internal microphone signal of the headphone, produced by the internal microphone 3, by i) a first filter G or Ganc that, as part of an acoustic noise cancellation, ANC, subsystem, produces an anti-noise audio signal, and a second filter C to produce a feedback audio signal. This feedback audio signal drives an input of the speaker 7 of the headphone as shown. In the online estimation operation, the processor determines an estimate of a transfer function of a path S, wherein the path S is as shown, from i) an input of the speaker 7 to the internal microphone signal.

The filter G and the filter C are coupled to each other in cascade, in a feedback path that extends from the output of the internal microphone 3 to the input of the speaker 7. The order in which the filter G and the filter C are coupled to each other in cascade may be reversed. The filter G is a digital filter that may be fixed in that its filter coefficients do not vary dynamically on a per audio frame basis (where each digital audio frame may for example be 5 msec-10 msec long.) The filer G may vary slowly, for example at least every three seconds. It may be determined offline and may be a function of the latency in reacting to the signal from the internal microphone 3 (for producing an anti-noise signal at the output of the filter G.) In contrast, the processor adapts the second filter C online and dynamically, for example every one or two audio frames whenever an estimate of the transfer function of the path S is updated. FIG. 1 shows an example of how the estimate of the transfer function of the path S, Sest, can be dynamically updated online by an adaptive filter engine such as a least mean squares, LMS, engine, based on the error or difference between i) an Sest-filtered version of an audio signal (e.g., user content audio) and the audio signal after it has passed through the path S.

Figure 2:
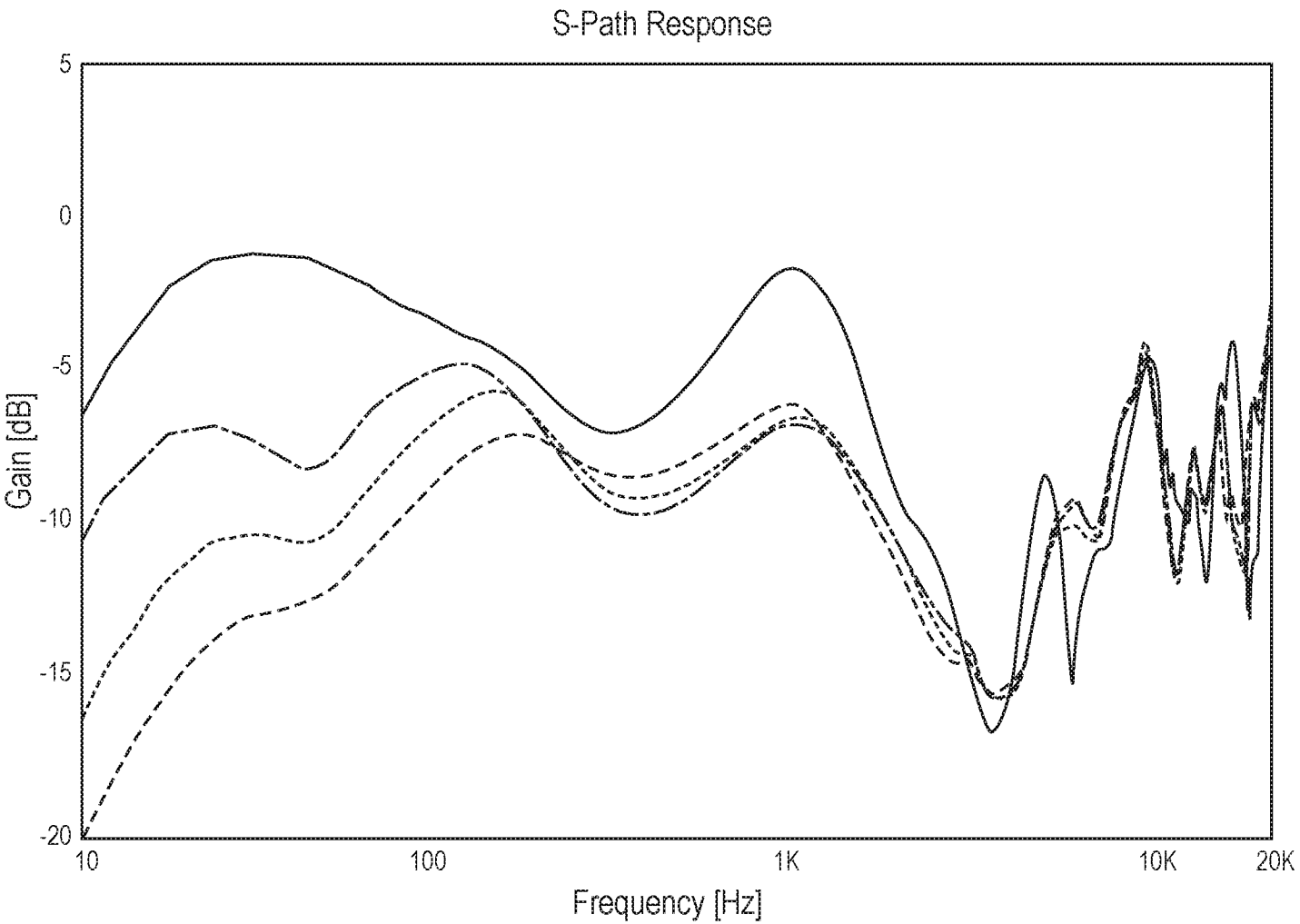
FIG. 2 shows an example of variation in the transfer function of the path S in a headphone audio system, across users with varying fit between a headphone and the users' ear.

Motivation for the method of FIG. 1 may be appreciated by considering how the path S transfer function varies across different users and different instances of the fit of the headphone against a particular user's ear, as depicted by the four curves in FIG. 2. It can be seen that at 100 Hz there is about 15 dB variation between a tightly fitting version and a loosely fitting version of the headphone (and where the graph also shows two intermediate fits.) If the cascade of filters G, C were replaced with a fixed filter, F, then the illustrated variation in the path S would result in low performance by the ANC subsystem (low gain attenuation of the undesired ambient sound) and unpleasant audible artifacts (e.g., excessive gain boosts at certain frequencies) that might be heard by the wearer. The solution depicted in FIG. 1 does not use a fixed filter C, but instead adapts the filter C as required, depending on the fit of the headphone which may be represented by Sest.

As introduced above, the filter F in the feedback is divided into two parts, namely the filter G which applies a gain to provide acoustic noise cancellation, and the filter C which may be the inverse of the shape of the gain response of the path S, or an inverse of a minimum phase version of the transfer function S, $S_{mp}^{-1}$. This means that the product, $S_{mp}^{-1}*S_{median}$, where $S_{median}$ is an ideal transfer function or an average of many users and fits, is flat in frequency domain. Adapting the filter C therefore calls for adapting $S_{mp}^{-1}$, by computing its filter coefficients in real time, e.g., on a per audio frame basis, using an estimation algorithm (performed by the processor as configured according to the online estimation block shown in FIG. 1.)

Figure 3:
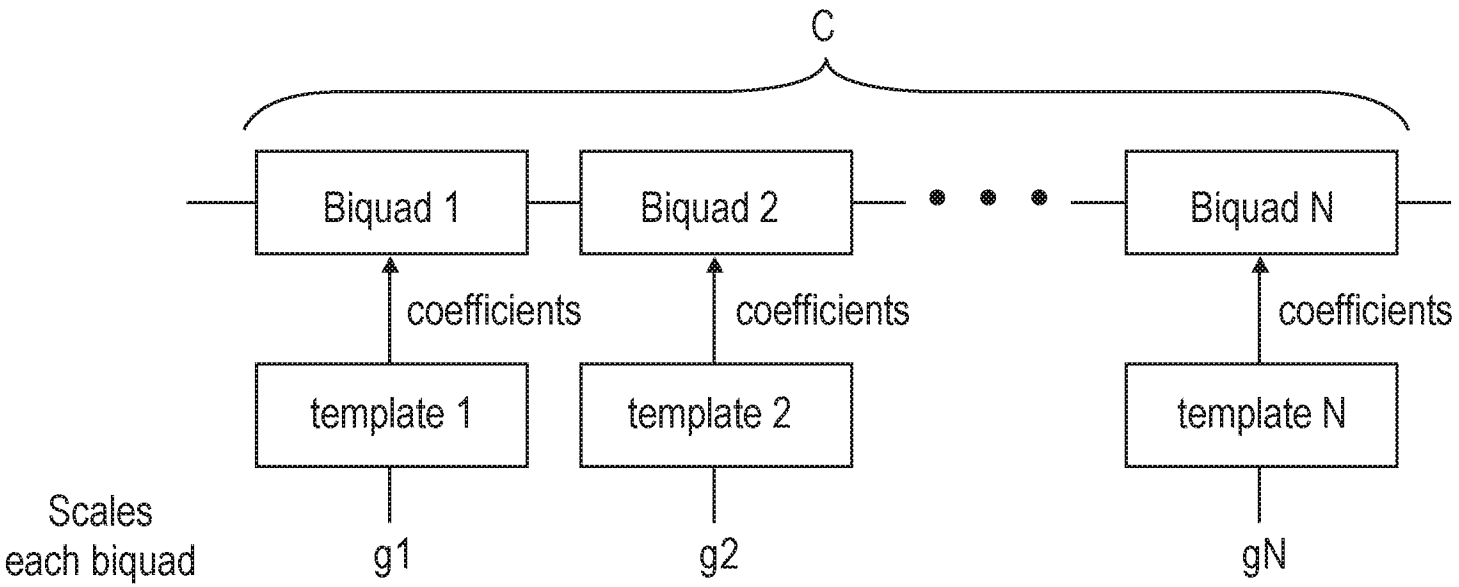
FIG. 3 shows an example implementation of the filter C using a cascade of biquads.
Figure 4:
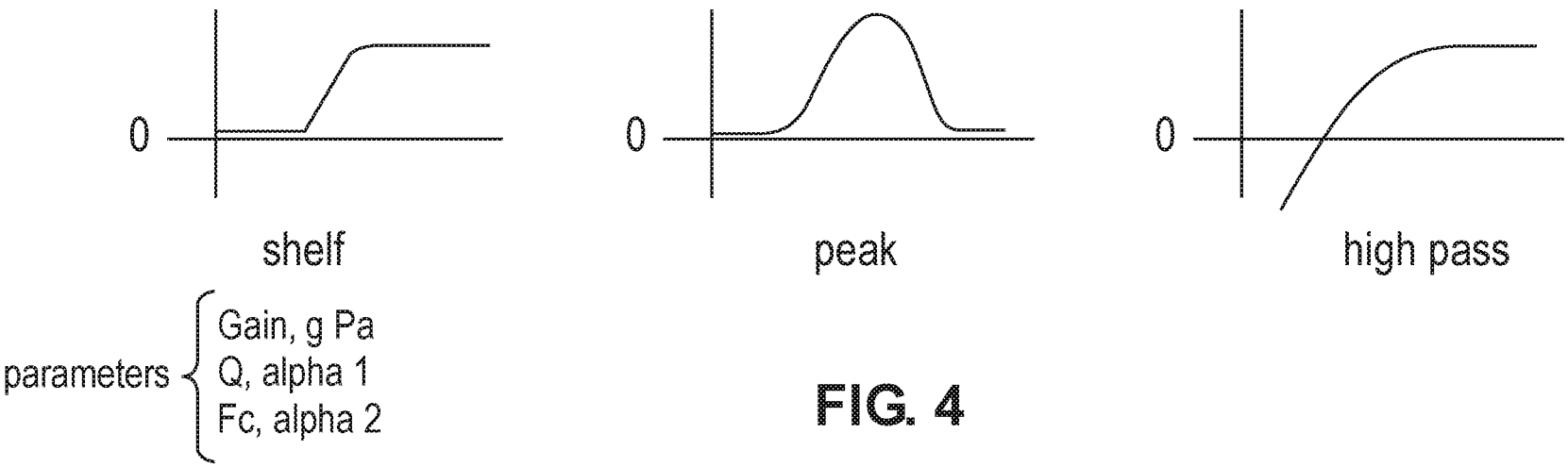
FIG. 4 shows an example set of three templates that can be used to compute the coefficients of the biquads.

The online estimation algorithm to compute the filter C may be as follows. The filter C is modeled as several, infinite impulse response biquads coupled in cascade (series) as shown in FIG. 3. A least squares estimation process is performed to directly compute the filter coefficients of each biquad, where directly computing the coefficient is in contrast to performing a table look up to select a set of previously determined filter coefficients. In particular, the coefficients of each biquad are calculated using a biquad template function as depicted in FIG. 3. The template function may have the following properties: it is parametric (can be computed using a handful of parameters such as quality factor, Q, of a two-pole resonator (alpha1) and cut off frequency or center frequency, Fc (alpha2); it is scalable in the cepstral domain according to a gain parameter, g, that scales their real cepstrum linearly; and it is minimum phase. Examples of such templates are a shelf filter, a peak filter and a high pass filter as shown in FIG. 4. Other template combinations are possible. Note that the templates and their parameters alpha1 and alpha2 may be determined in an offline process and then stored in memory inside the headphone housing for use by the online estimation process. The gain parameters, g, however are computed online and in real-time as described below (using the estimate, Sest, of the transfer function of the path S), and then applied to scale the templates which are then used to compute the biquad coefficients.

Note that this online estimation process may result in altering the transfer function of the second filter C over a wide frequency band, from 10 Hz to 10 kHz. Every one of the biquad filters is updated based on a same estimate of the transfer function of the path S. In this manner, the resulting F filter (a combination of the filter G and filter C in cascade) as part of the ANC subsystem results in more consistent noise cancellation performance across different users.

Figure 5:
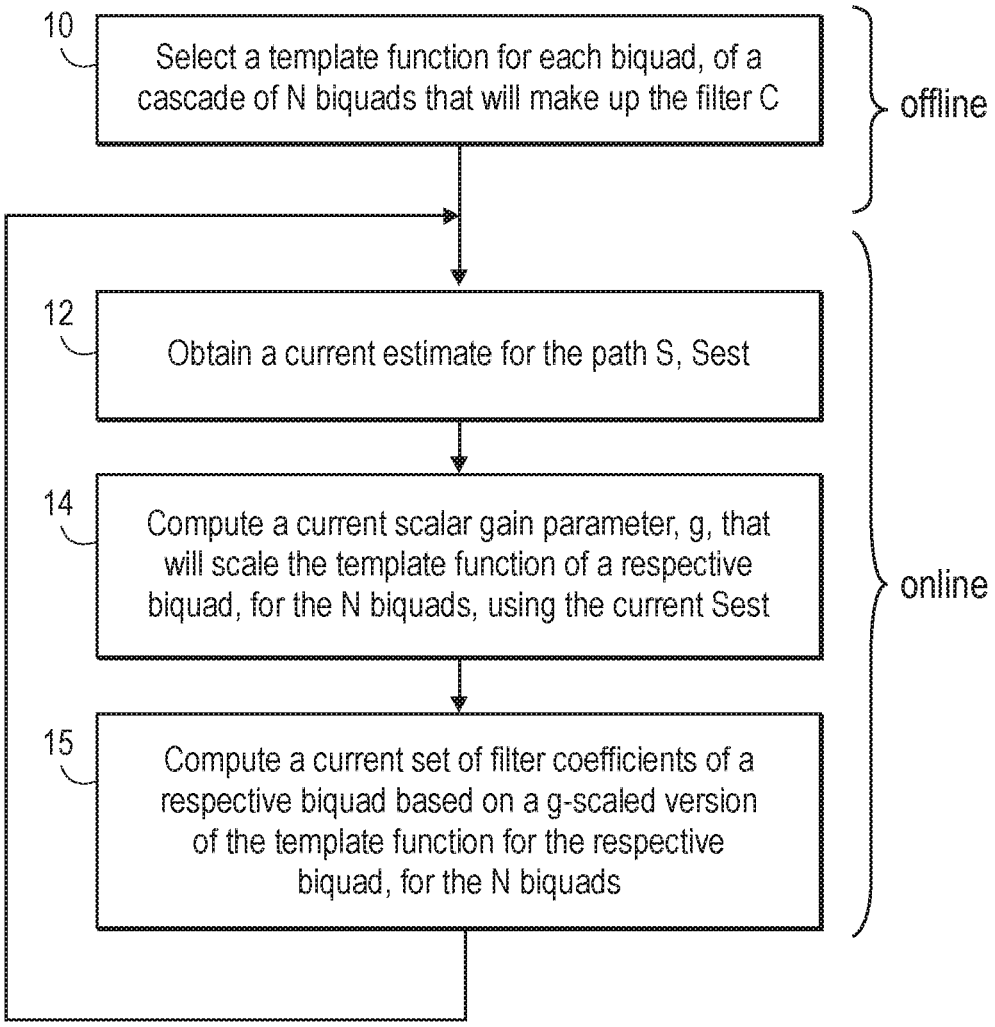
FIG. 5 is a flow diagram of an audio signal processing method for a headphone audio system.

FIG. 5 is a flow diagram an audio signal processing method for a headphone audio system, in which a processor adapts the N biquads (N being two or more) that make up the second filter C by determining a least squares fit of the estimate of the transfer function of the path S using template functions, and computes the filter coefficients of the biquads based on the least squares fit (collectively the online estimation block in FIG. 1.) Prior to the online estimation method though, there is operation 10 in which a template function is selected for each biquad. As explained below, operation 10 may be performed offline and the resulting selected template functions can then be stored in memory ready for the processor to use in its online estimation process (when the ANC functionality is activated.) The online process can be viewed as a loop that may be repeated each time a current estimate for the path S, Sest, is obtained (operation 12.) As explained above and shown in FIG. 1, this may be performed by an LMS engine which computes digital filter coefficients Sest online while the user is wearing the headphone and some stimulus input audio signal, e.g., the user content or playback signal, is being output through the speaker 7.

Returning to FIG. 5, the process then continues with operation 14, computing a current scalar gain parameter, g, that will scale the template function of a respective biquad—see FIG. 3, a vector of gain parameters g1, g2, . . . gN. A set of linear equations may be solved to obtain the vector of gain parameters g1, g2, . . . gN, represented as G=P*Sest where P is a matrix inverse or pseudo inverse of a matrix that is composed of the individual template functions given in frequency domain format, and Sest is a vector of imaginary values of the transfer function of the path S. Finally, in operation 15, a current set of filter coefficients of a respective biquad is computed, based on a g-scaled version of the template function for the respective biquad, for the N biquads—see FIG. 3. This results in the cascade of the N biquads which is the filter C in FIG. 1 to be updated. The method loops back and resumes with operation 12, when a new current estimate for the path S becomes available.

Regarding the template function selection in operation 10, recall that a goal of the cascade of biquads and their respective gain parameters g1, g2, . . . gN is to flatten the overall response of the feedback path (see FIG. 1) despite changes in headphone fit that affect Sest. When the biquads imperfectly match the inverse of Sest, a cost function can be written that may be optimized by finding a set of biquad templates that minimizes this cost function across all expected headphone fit variations (across various users.) Any one of several nonlinear optimization procedures may be used to find a set of biquad template functions (and their associated parameters.)

Turning now to FIG. 6, this is a block diagram of part of a headphone audio system having feedforward ANC combined with the adaptive feedback path technique described above in connection with FIG. 1. The system has an external microphone 5 (one or more external microphones 5) which produces an external microphone signal of the headphone that is filtered by filter W to produce a feedforward audio signal for driving the input of the speaker 7. The feedforward audio signal may be an anti-noise signal when using a filter W to produce it, where the filter W is being adapted online. The filter W may be adapted by an adaptive filter algorithm such as an LMS engine, based on the current estimate of the transfer function of path S, Sest, and based on the residual noise as picked up by the internal microphone 3. Note the residual noise as an error signal to the LMS engine is produced by removing a contribution of the playback signal dl as filtered by a target or desired estimate Smid of the transfer function of path S (e.g., $S_{median}$), and also removing the effect of the adaptive feedpack path by filtering through the transfer function 1-F*Sest where F is a cascade of the filter G and the filter C. The feedforward audio signal produced by filter W is combined with the feedback audio signal and the user content audio signal as shown, for driving the input of the speaker 7.

In the case of FIG. 6 where both feedforward ANC and adaptive feedback are active contemporaneously with playback of user content, the contribution by the user content as the signal dl that appears at the output of the filter mediaEQ is removed from the output of the error microphone 3 for the feedback path which then goes through the cascade of the filters C, G as shown.

While certain aspects have been described above and shown in the accompanying drawings, it is to be understood that such descriptions are merely illustrative of and not restrictive on the invention, and that the invention is not limited to the specific constructions and arrangements shown and described, since various other modifications may occur to those of ordinary skill in the art. For example, although FIG. 5 shows a loop that is repeated each time there is a current estimate of path S, the loop does not have to use each and every current estimate of path S that is computed for each and every audio frame—some instances of the current estimate of the path S may be skipped by the online estimation process. Furthermore, the particular features, structures, configurations, or characteristics may be combined in any suitable manner in one or more embodiments.

What is claimed is:

1. An audio signal processing method for a headphone, comprising:

filtering an internal microphone signal of a headphone by i) a first filter G that, as part of an acoustic noise cancellation, ANC, subsystem, produces an anti-noise audio signal, and ii) a second filter C to produce a feedback audio signal, wherein the first filter and the second filter operate based on the same audio frame of the internal microphone signal;

determining an estimate of a transfer function of a path S, wherein the path S is from i) an input of a speaker of the headphone to ii) the internal microphone signal;

adapting the second filter C based on the estimate of the transfer function of the path S; and driving by the feedback audio signal an input of a speaker of the headphone.

2. The method of claim 1 wherein the second filter C comprises a plurality of biquads, and adapting the second filter C comprises computing a plurality of gain parameters using the estimate of the transfer function of the path S;

scaling a plurality of template functions by the plurality of gain parameters, respectively; and computing filter coefficients of the plurality of biquads based on scaling the plurality of template functions.

3. The method of claim 1 wherein adapting the second filter C comprises performing a least squares estimation to directly produce digital filter coefficients of the second filter C.

4. The method of claim 1 wherein adapting the second filter C comprises altering a transfer function of the second filter C from 10 Hz to 10 kHz.

5. The method of claim 1 further comprising removing from the internal microphone signal a contribution by a user content audio signal, before filtering by the first filter G.

6. The method of claim 1 wherein the second filter C comprises a plurality of infinite impulse response biquad filters coupled in cascade, and wherein every one of the biquad filters is updated based on a same estimate of the transfer function of the path S.

7. The method of claim 6 wherein the second filter C has a transfer function that is an inverse of a minimum phase version of the estimate of the transfer function of the path S.

8. The method of claim 1 further comprising:

filtering an external microphone signal of the headphone by third filter W, to produce a feedforward audio signal; and combining the feedforward audio signal with the feedback audio signal for driving the input of the speaker.

9. The method of claim 8 wherein the third filter is part an ANC subsystem and produces an anti-noise signal.

10. The method of claim 8 further comprising combining the feedforward audio signal and the feedback audio signal with a user content audio signal for driving the input of the speaker; and removing from the internal microphone signal a contribution by the user content audio signal, before filtering by the first filter G.

11. The method of claim 10 further comprising filtering the user content audio signal by a fourth filter, before combining the filtered user content audio signal with the feedforward and feedback audio signals wherein the fourth filter is fixed or is updated less frequently than the second filter C.

12. The method of claim 1 wherein determining the estimate of the transfer function of the path S comprises performing an adaptive filter algorithm that repeatedly updates the estimate of the transfer function on a per audio frame basis.

13. A headphone audio system comprising:

a headphone housing having integrated therein an internal microphone to produce an internal microphone signal, and a speaker;

a processor; and memory having stored therein instructions that configure the processor to filter the internal microphone signal by i) a first filter G that, as part of an acoustic noise cancellation, ANC, subsystem, produces an anti-noise audio signal, and ii) a second filter C to produce a feedback audio signal, wherein the first filter is coupled in cascade with the second filter, determine an estimate of a transfer function of a path S, wherein the path S is from i) an input of the speaker to ii) the internal microphone signal, adapt the second filter C based on the estimate of the transfer function of the path S, and drive the input of the speaker with the feedback audio signal.

14. The headphone audio system of claim 13 wherein the processor and memory are integrated in the headphone housing.

15. The headphone audio system of claim 13 wherein the second filter C comprises a plurality of biquads, and the processor adapts the second filter C by determining a least squares fit of the estimate of the transfer function of the path S using a plurality of template functions, and computing filter coefficients of the biquads based on the least squares fit.

16. The headphone audio system of claim 13 wherein processor adapts the second filter C by altering a transfer function of the second filter C from 10 Hz to 10 kHz.

17. The headphone audio system of claim 13 wherein the processor removes from the internal microphone signal a contribution by a user content audio signal, before filtering by the first filter G.

18. The headphone audio system of claim 13 wherein the second filter C comprises a plurality of infinite impulse response biquad filters coupled in cascade, and wherein every one of the biquad filters is updated based on a same estimate of the transfer function of the path S.

19. The headphone audio system of claim 13 wherein the second filter C has a transfer function that is an inverse of a minimum phase version of the estimate of the transfer function of the path S.

20. The headphone audio system of claim 13 further comprising an external microphone integrated in the headphone housing, and wherein the memory has stored therein further instructions that configure the processor to:

filter an external microphone signal produced by the external microphone by a third filter W, to produce a feedforward audio signal; and combine the feedforward audio signal with the feedback audio signal for driving the input of the speaker.

21. A processor for use with a headphone, the processor comprising a processor configured to:

filter an internal microphone signal by i) a first filter that, as part of an acoustic noise cancellation, ANC, subsystem, produces an anti-noise audio signal, and ii) a second filter that produces a feedback audio signal, wherein the first filter and the second filter are coupled in cascade, determine an estimate of a transfer function of a path S, wherein the path S is from i) an input of a speaker to ii) the internal microphone signal, adapt the second filter based on the estimate of the transfer function of the path S, and drive the input of the speaker with the feedback audio signal.

22. The processor of claim 21 wherein the processor is further configured to remove from the internal microphone signal a contribution by a user content audio signal, before filtering by the first filter.

* * * * *